US007866575B2

(12) United States Patent
Straub

(10) Patent No.: US 7,866,575 B2
(45) Date of Patent: Jan. 11, 2011

(54) PRESSURE ACTUATED FUEL INJECTOR

(75) Inventor: Robert D. Straub, Lowell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 166 days.

(21) Appl. No.: 12/351,931

(22) Filed: Jan. 12, 2009

(65) Prior Publication Data

US 2010/0176222 A1 Jul. 15, 2010

(51) Int. Cl.

| | |
|---|---|
| ***F02M 47/00*** | (2006.01) |
| ***F02M 47/02*** | (2006.01) |
| ***F02M 55/00*** | (2006.01) |
| ***F02M 61/00*** | (2006.01) |
| ***F02M 63/00*** | (2006.01) |

(52) U.S. Cl. ..... 239/533.3; 239/88

(58) Field of Classification Search ..... 239/88–92, 239/96, 533.2–533.12, 585.1–585.5
See application file for complete search history.

(56) References Cited

U.S. PATENT DOCUMENTS

2004/0021011 A1* 2/2004 Ruthardt et al. ..... 239/533.11
2004/0026645 A1* 2/2004 Hanneke et al. ..... 251/129.19
2008/0191064 A1* 8/2008 Sawaki et al. ..... 239/533.11
2008/0272214 A1* 11/2008 Male et al. ..... 239/533.3

* cited by examiner

*Primary Examiner*—Darren W Gorman
(74) *Attorney, Agent, or Firm*—Harness, Dickey & Pierce, P.L.C.

(57) ABSTRACT

An engine assembly may include a fuel injector having a housing, an actuation mechanism, and a valve member. The housing may define a high pressure region, a low pressure region, a longitudinal bore, and a valve seat having an aperture extending therethrough. The actuation member may be disposed within the longitudinal bore and may include a first axial end surface. The valve mechanism may include a second axial end surface abutting the first axial end surface. The first and second axial end surfaces define an outer contact perimeter and a chamber within the outer contact perimeter. A radial surface area defined by the chamber formed by the first and second axial end surfaces may be at least 25 percent of a radial surface area defined within the outer contact perimeter.

20 Claims, 5 Drawing Sheets

PRESSURE ACTUATED FUEL INJECTOR

FIELD

The present disclosure relates to engine fuel systems, and more specifically to fuel injectors.

BACKGROUND

The statements in this section merely provide background information related to the present disclosure and may not constitute prior art.

Pressure actuated fuel injectors may include a pressurized fuel supply used to open and close an injection nozzle opening. The injector may include an actuation member and a valve mechanism to selective open and close a leakage path between low pressure and high pressure regions of the injector. Opening the leakage path may reduce a closing biasing force applied to an injection valve to open the injection nozzle opening. When the leakage path is closed, the injection valve may be displaced to close the injection nozzle opening. Friction forces between the actuation member and the valve mechanism may provide difficulties in maintaining the valve mechanism in a fully seating condition when an injection event is completed.

SUMMARY

An engine assembly may include a fuel injector having a housing, an actuation mechanism, and a valve member. The housing may define a high pressure region, a low pressure region, a longitudinal bore, and a valve seat having an aperture extending therethrough. The actuation member may be disposed within the longitudinal bore and may include a first axial end surface. The valve mechanism may be axially displaceable between first and second positions. The valve mechanism may abut the valve seat in the first position to seal the aperture from communication with the low pressure region and may be displaced from the valve seat in the second position to provide communication between the low and high pressure regions through the aperture. The valve mechanism may include a second axial end surface abutting the first axial end surface. The first and second axial end surfaces may define an outer contact perimeter and a chamber within the outer contact perimeter. A radial surface area defined by the chamber formed by the first and second axial end surfaces may be at least 25 percent of a radial surface area defined within the outer contact perimeter.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
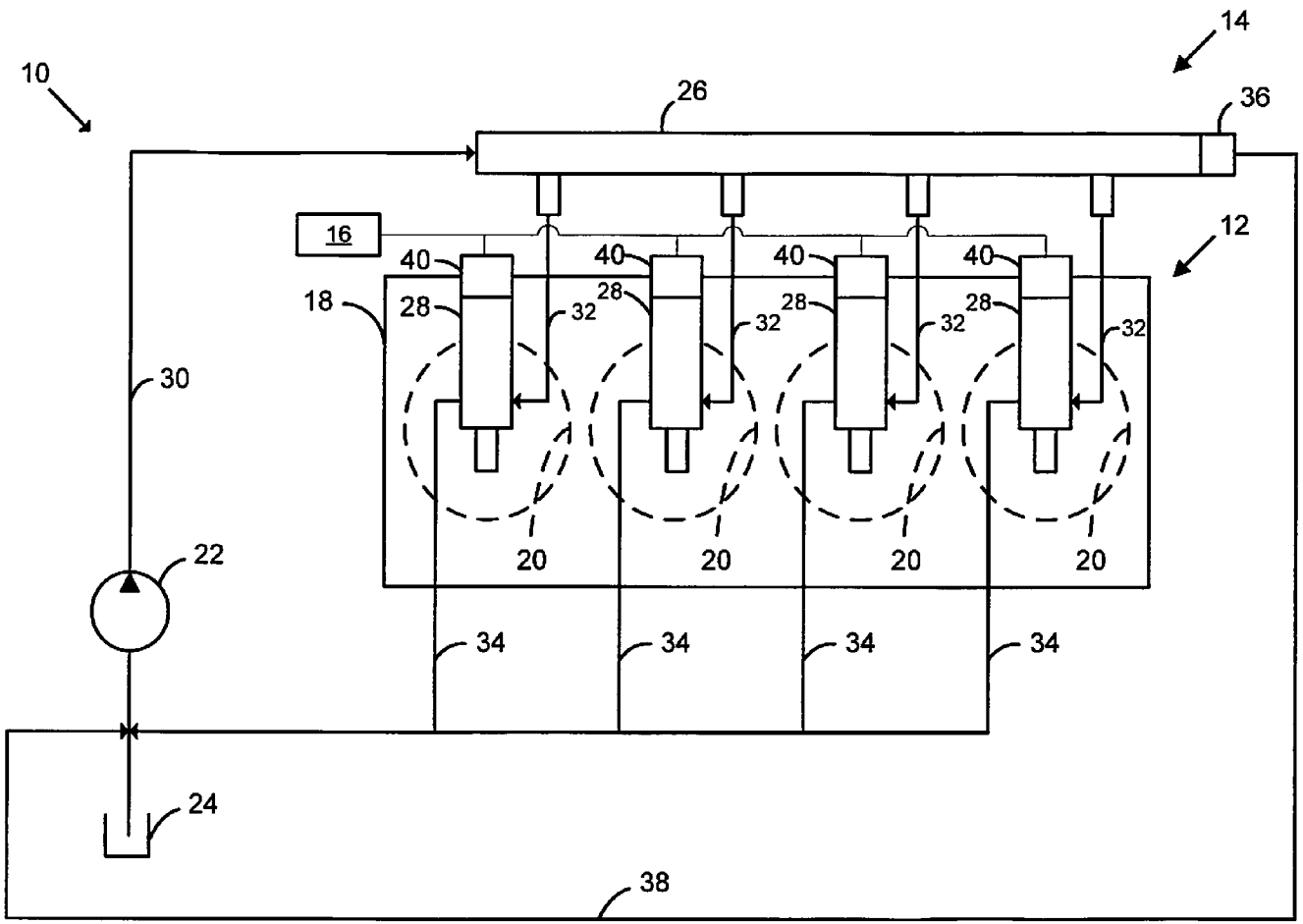
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, an exemplary engine assembly 10 is schematically illustrated. The engine assembly 10 may include an engine 12 in communication with a fuel system 14 and a control module 16. In the example shown, the engine 12 may include an engine block 18 that defines a plurality of cylinders 20 in communication with the fuel system 14. While the engine 12 is illustrated as a four cylinder engine in the present disclosure it is understood that the present teachings apply to a variety of engine configurations and is in no way limited to the configuration shown.

The fuel system 14 may include a fuel pump 22, a fuel tank 24, a fuel rail 26, fuel injectors 28, a main fuel supply line 30, secondary fuel supply lines 32 and fuel return lines 34. The fuel pump 22 may be in communication with the fuel tank 24 and may provide a pressurized fuel supply to the fuel rail 26 via the main fuel supply line 30. The fuel rail 26 may provide the pressurized fuel to injectors 28 via the secondary fuel supply lines 32. The fuel rail 26 may include a pressure regulating valve 36 that regulates fuel pressure within the fuel rail 26 by returning excess fuel to the fuel tank 24 via a return line 38.

The fuel injectors 28 may each include a solenoid valve mechanism 40 in communication with the control module 16. In the present non-limiting example, the fuel injectors 28 may form direct injection fuel injectors where fuel is injected directly into the cylinders 20. The fuel injectors 28 may return excess fuel to the fuel tank 24 via the fuel return lines 34.

Figure 2:
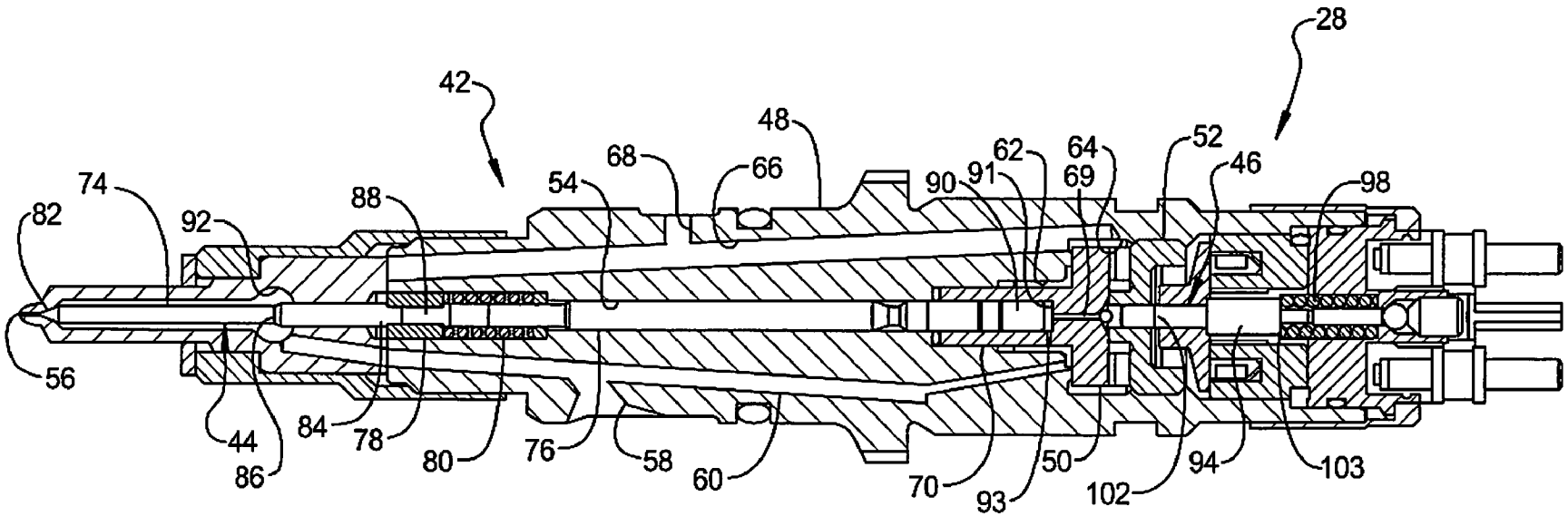
FIG. 2 is a section view of a fuel injector of the engine assembly of FIG. 1.

With reference to FIG. 2, the fuel injector 28 may include a housing 42, an injection valve assembly 44 and an actuation assembly 46. The housing 42 may include a main body portion 48, a valve seat 50 and a first guide member 52. The main body portion 48 may define a first longitudinal bore 54, a nozzle opening 56, a fuel inlet 58, a high pressure fuel passage 60, a high pressure fuel chamber 62, a low pressure fuel chamber 64, a low pressure fuel passage 66 and a fuel outlet 68. The first longitudinal bore 54 may be in communication with the nozzle opening 56. The valve seat 50 may be located at an end of the first longitudinal bore 54 opposite the nozzle opening 56 and may separate the high pressure chamber 62 from the low pressure chamber 64.

Figure 3:
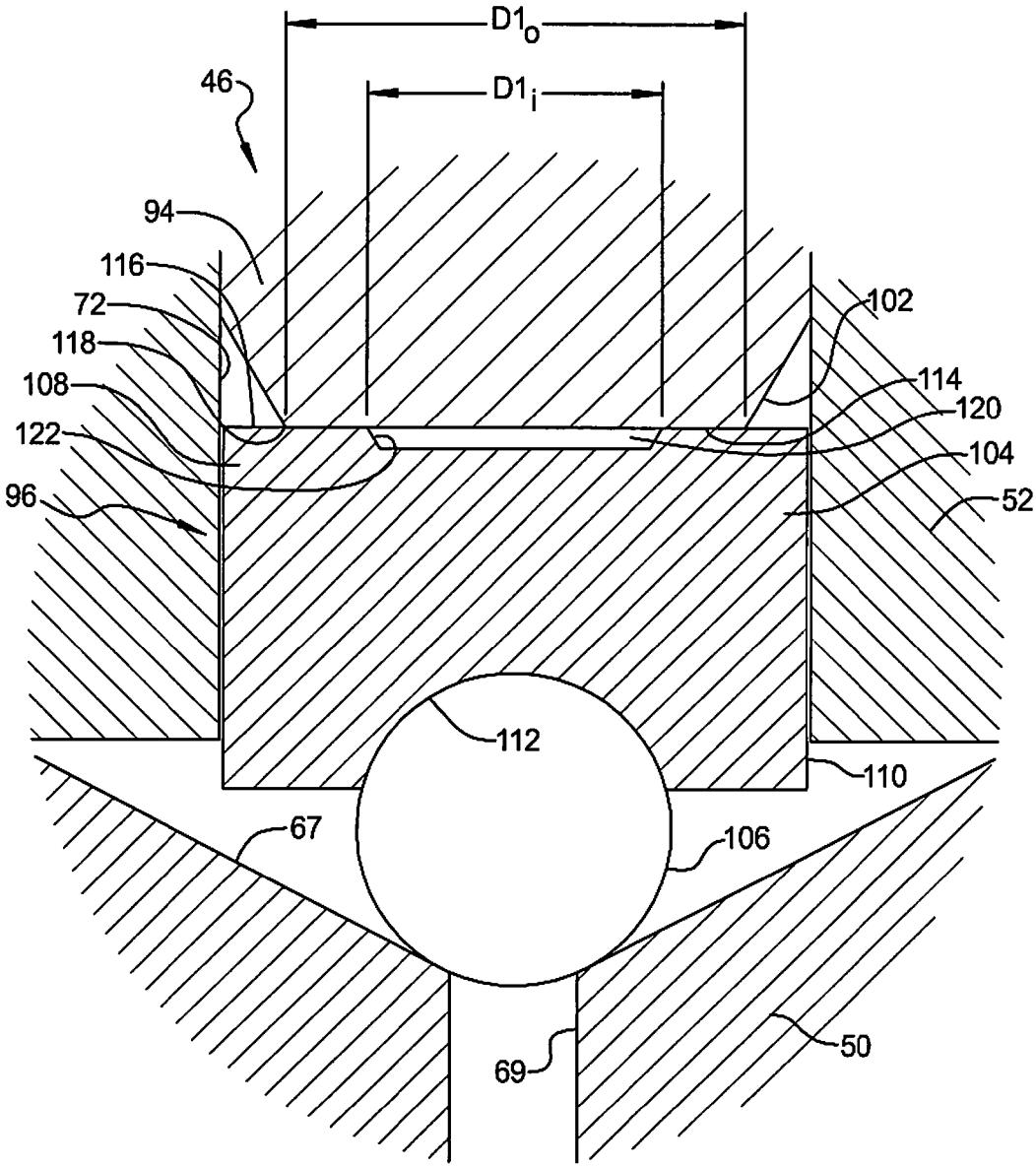
FIG. 3 is a fragmentary section view of the fuel injector of FIG. 2.

With reference to FIGS. 2 and 3, the valve seat 50 may include a valve seat surface 67, an aperture 69 and a second guide member 70. The valve seat surface 67 may be in fluid communication with the low pressure chamber 64. The first guide member 52 may be located in the low pressure chamber 64 and may define a second longitudinal bore 72 for guiding the actuation assembly 46.

As seen in FIG. 2, the injection valve assembly 44 may be located in the first longitudinal bore 54 and may include a first valve member 74, a plunger 76, a sleeve 78 and a first biasing member 80. The first valve member 74 may include a needle valve having a first end 82 for opening and closing the nozzle opening 56, a second end 84 opposite the first end 82 and a stepped region axially between the first and second ends 82, 84 forming a radial surface 86. The second end 84 of the first valve member 74 may abut the sleeve 78 and a first end 88 of the plunger 76. A second end 90 of the plunger 76 may be located within the second guide member 70 and may cooperate with the second guide member 70 to form a biasing chamber 91. An orifice 93 may extend through the second guide member 70 to provide communication between the biasing chamber 91 and the high pressure chamber 62. The aperture 69 may extend through the valve seat surface 67 into the biasing chamber 91. The orifice 93 may provide a greater flow restriction than the aperture 69.

The first biasing member 80 may include a compression spring and may be engaged with the main body portion 48 of the housing 42 and the sleeve 78. The force applied to the sleeve 78 by the first biasing member 80 and the pressurized fuel within the high pressure chamber acting on the second end 90 of the plunger 76 may normally bias the first valve member 74 into the closed position (seen in FIG. 2). The first longitudinal bore 54 may include a recess 92 surrounding the stepped region of the first valve member 74. The recess 92 may be in communication with the high pressure fuel passage 60 and provide pressurized fuel to the nozzle opening 56 when the first valve member 74 is in an open position (not shown).

Referring to FIG. 3, the actuation assembly 46 may include an actuation member 94, a valve mechanism 96 and a second biasing member 98 (seen in FIG. 2). The actuation member 94 may include an armature located within the second longitudinal bore 72 of the first guide member 52. A first end 102 of the actuation member 94 may abut the valve mechanism 96 and a second end 103 may be engaged with the second biasing member 98. A first end 108 of the valve mechanism 96 may abut the first end 102 of the actuation member 94.

The valve mechanism 96 may be radially and axially displaceable relative to the actuation member 94 and may include a valve holder 104 and a second valve member 106. A radial clearance may exist between the guide member 52 and the valve holder 104 to accommodate assembly tolerances. The valve holder 104 may include the first end 108 of the valve mechanism 96 and may further include a second end 110 housing the second valve member 106. For example, the second end 110 may include a recess 112 housing the second valve member 106. By way of non-limiting example, the second valve member 106 may include a ball and the recess 112 may include a shape generally conforming to the second valve member 106, such as a semi-spherical recess or a conical recess. While described as two separate parts, it is understood that the valve holder 104 and the second valve member 106 may be fixed to one another to form a single part.

As discussed above, the first end 102 of the actuation member 94 may abut the first end 108 of the valve mechanism 96. The first end 102 of the actuation member 94 may form a first axial end surface 114 and the first end 108 of the valve mechanism 96 may form a second axial end surface 116. The abutment between first and second axial end surfaces 114, 116 may define an outer contact perimeter 118. The first and second axial end surfaces 114, 116 may cooperate to define a chamber 120 between the first and second axial end surfaces 114, 116. The chamber 120 may provide a spacing between central portions of the first and second axial end surfaces 114, 116 located radially within the outer contact perimeter 118. The chamber 120 may form a radial surface area at least twenty-five percent of the radial surface area located within the outer contact perimeter 118. More specifically, in the present non-limiting example, the chamber 120 may form a radial surface area between fifty and ninety-five percent of the radial surface area located within the outer contact perimeter 118.

In the present non-limiting example (seen in FIG. 3), a recess 122 may extend axially into the second axial end surface 116 and radially within the outer contact perimeter 118. The first axial end surface 114 may be generally planar within the outer contact perimeter 118. The recess 122 and the generally planar first axial end surface 114 may form the chamber 120. In the present example, the outer contact perimeter 118 may be defined by an outer contact diameter ($D1_o$) of the first and second axial end surfaces 114, 116 and the recess 122 may be defined within an inner contact diameter ($D1_i$).

The radial surface area ($A1_1$) formed by the engagement between the first and second axial end surfaces 114,116 may be defined as the area between the inner and outer contact diameters ($D1_i$, $D1_o$) and may form an annular contact region between the first and second axial end surfaces 114, 116. The radial surface area ($A1_1$) may be at least twenty-five percent of a radial surface area ($A1_2$) defined by the outer contact diameter ($D1_o$). More specifically, the radial surface area ($A1_1$) may be between fifty and ninety-five percent of the radial surface area ($A1_2$).

Figure 4:
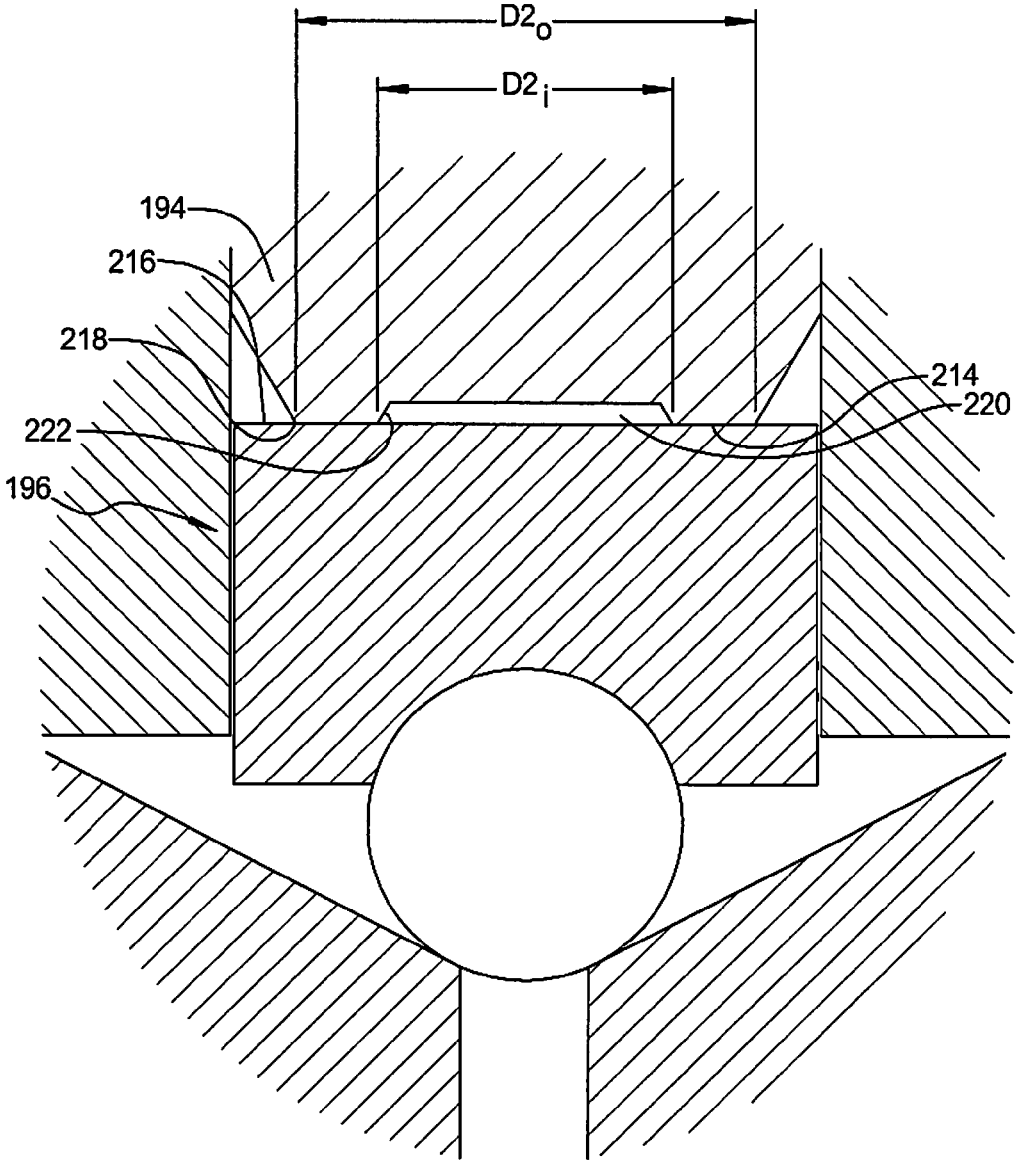
FIG. 4 is a fragmentary section view of an alternate fuel injector according to the present disclosure.

An alternate actuation member 194 and valve mechanism 196 are shown in FIG. 4. The actuation member 194 and valve mechanism 196 may be generally similar to the actuation member 94 and the valve mechanism 96, with exceptions noted below. In the non-limiting example of FIG. 4, a recess 222 may extend axially into the first axial end surface 214 and radially within the outer contact perimeter 218. The second axial end surface 216 may be generally planar within the outer contact perimeter 218. The recess 222 and the generally planar second axial end surface 216 may form the chamber 220. In the present example, the outer contact perimeter 218 may be defined by an outer contact diameter ($D2_o$) of the first and second axial end surfaces 214, 216 and the recess 222 may be defined within an inner contact diameter ($D2_i$).

The radial surface area ($A2_1$) formed by the engagement between the first and second axial end surfaces 214, 216 may be defined as the area between the inner and outer contact diameters ($D2_i$, $D2_o$) and may form an annular contact region between the first and second axial end surfaces 214, 216. The radial surface area ($A2_1$) may be at least twenty-five percent of a radial surface area ($A2_2$) defined by the outer contact diameter ($D2_o$). More specifically, the radial surface area ($A2_1$) may be between fifty and ninety-five percent of the radial surface area ($A2_1$).

Figure 5:
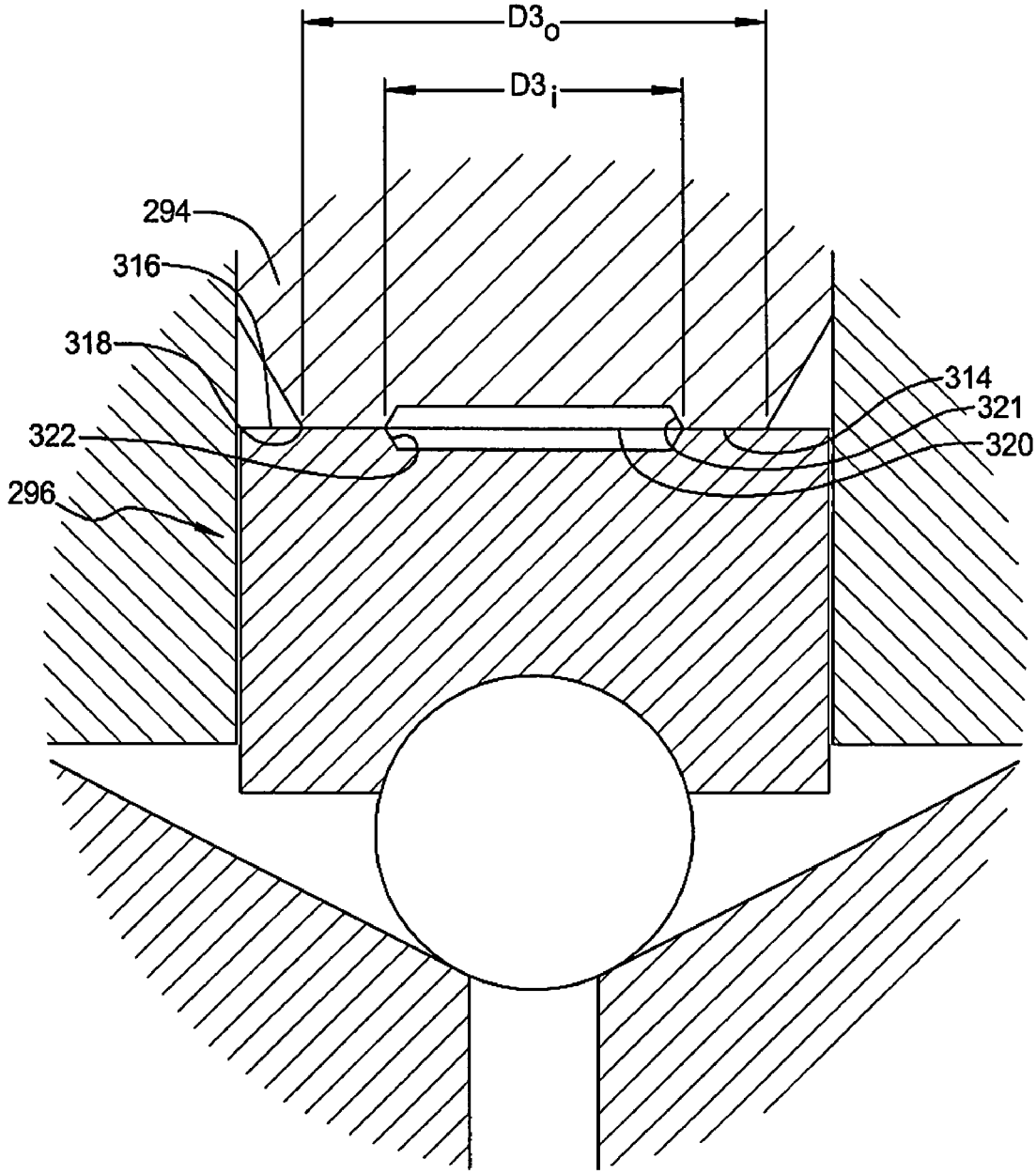
FIG. 5 is a fragmentary section view of an alternate fuel injector according to the present disclosure.

An alternate actuation member 294 and valve mechanism 296 are shown in FIG. 5. The actuation member 294 may be generally similar to the actuation member 194 of FIG. 4 and the valve mechanism 296 may be generally similar to the valve mechanism 96 of FIG. 3. In the non-limiting example of FIG. 5, a first recess 321 may extend axially into and radially within the outer contact perimeter 318 and a second recess 322 may extend axially into the second axial end surface 316 and radially within the outer contact perimeter 318. The first and second recesses 321, 322 may form the chamber 320. In the present example, the outer contact perimeter 318 may be defined by an outer contact diameter ($D3_o$) of the first and second axial end surfaces 314, 316 and the first and second recesses 321, 322 may be defined within an inner contact diameter ($D3_i$).

The radial surface area ($A3_1$) formed by the engagement between the first and second axial end surfaces 314, 316 may be defined as the area between the inner and outer contact diameters ($D3_i$, $D3_o$) and may form an annular contact region between the first and second axial end surfaces 314, 316. The radial surface area ($A3_1$) may be at least twenty-five percent of a radial surface area ($A3_2$) defined by the outer contact diameter ($D3_o$). More specifically, the radial surface area ($A3_1$) may be between fifty and ninety-five percent of the radial surface area ($A3_2$).

The fuel injector 28 may be a pressure actuated fuel injector, where fuel pressure opens the nozzle opening 56. During operation, the control module 16 may selectively command opening and closing of the nozzle opening 56 using the solenoid valve mechanisms 40. When injection is desired, the solenoid valve 40 may displace the actuation member 94 in a direction axially outward from the valve seat 50 against the force of the basing member 98. Pressurized fuel within the biasing chamber 91 may force the valve mechanism 96 axially outward from the valve seat 50 once the actuation member 94 is displaced, providing a leak path between the biasing chamber 91 and low pressure fuel chamber 64. The leakage may provide a pressure drop in the biasing fuel chamber 91, reducing a biasing force applied to the second end 90 of the plunger 76 by the fuel within the biasing chamber 91.

The reduced biasing force applied by the fuel within the biasing chamber 91 may provide for displacement of the first valve member 74 and opening of the nozzle opening 56. More specifically, the force applied to the radial surface 86 by fuel within the recess 92 may be sufficient to overcome the force applied by the biasing member 80 and the reduced force applied to the second end 90 of the plunger 76 by the fuel within the biasing chamber 91, resulting in the displacement of the first valve member 74.

After a desired injection event is completed, the solenoid valve 40 may be de-energized and the biasing member 98 may return the valve mechanism 96 to a closed condition. The various examples of offset central surfaces created by the chambers 120, 220, 320 may provide for a complete seating of the second valve member 106 on the valve seat 50. Further, it is understood that while the injector 28 has been described as providing fuel to an engine cylinder, other applications may use the present teachings. For example, the fuel injector 28 may alternatively or additionally be used to inject fuel into an exhaust aftertreatment system (not shown).

What is claimed is:

1. A fuel injector comprising:

a housing defining a high pressure region, a low pressure region, a longitudinal bore, and a valve seat including a valve seat surface and an aperture, the valve seat surface being in fluid communication with the low pressure region and the aperture extending through the valve seat surface and being in communication with the high pressure region;

an actuation member disposed within the longitudinal bore for axial displacement therein and including a first axial end surface; and a valve mechanism axially displaceable between first and second positions, the valve mechanism abutting the valve seat in the first position to seal the aperture from communication with the low pressure region, the valve mechanism being displaced from the valve seat in the second position to provide communication between the low and high pressure regions through the aperture, the valve mechanism including a second axial end surface abutting the first axial end surface of the actuation member, the first and second axial end surfaces defining an outer contact perimeter and a chamber within the outer contact perimeter, a radial surface area of the chamber formed by the first and second axial end surfaces being at least 25 percent of a radial surface area defined within the outer contact perimeter.

2. The fuel injector of claim 1, wherein the first axial end surface is generally planar within the outer contact perimeter and the second axial end surface includes a recess within the outer contact perimeter to form the chamber.

3. The fuel injector of claim 1, wherein the first axial end surface includes a first recess within the outer contact perimeter to form the chamber.

4. The fuel injector of claim 3, wherein the second axial end surface includes a second recess within the outer contact perimeter, the first and second recesses forming the chamber.

5. The fuel injector of claim 3, wherein the second axial end surface is generally planar within the outer contact perimeter.

6. The fuel injector of claim 1, wherein the radial surface area of the chamber formed by the first and second axial end surfaces is between 50 and 95 percent of the radial surface area defined by the outer contact perimeter.

7. The fuel injector of claim 1, wherein the first and second axial end surfaces are radially displaceable relative to one another.

8. The fuel injector of claim 1, wherein the valve mechanism includes a valve holder and a valve member, the valve holder including the second axial end surface at a first axial end and a third axial end surface at a second axial end opposite the first axial end, the third axial end surface including a recess housing the valve member.

9. The fuel injector of claim 8, wherein the valve member includes a ball.

10. The fuel injector of claim 1, further comprising an injection valve, the housing including an injection nozzle opening, the injection valve being displaceable from a third position where the injection valve seals the injection nozzle opening to a fourth position where the injection valve opens the nozzle opening, the injection valve being displaced from the third position to the fourth position by fuel pressure when the valve mechanism is displaced from the first position to the second position.

11. An engine assembly comprising:

an engine structure defining a cylinder bore; and a fuel injector supported by the engine structure and in communication with the cylinder bore, the fuel injector including:

a housing defining a high pressure region, a low pressure region, a longitudinal bore, and a valve seat including a valve seat surface and an aperture, the valve seat surface being in fluid communication with the low pressure region and the aperture extending through the valve seat surface and being in communication with the high pressure region;

an actuation member disposed within the longitudinal bore for axial displacement therein and including a first axial end surface; and a valve mechanism axially displaceable between first and second positions, the valve mechanism abutting the valve seat in the first position to seal the aperture from communication with the low pressure region, the valve mechanism being displaced from the valve seat in the second position to provide communication between the low and high pressure regions through the aperture, the valve mechanism including a second axial end surface abutting the first axial end surface of the actuation member, the first and second axial end surfaces defining an outer contact perimeter and a chamber within the outer contact perimeter, a radial surface area of the chamber formed by the first and second axial end surfaces being at least 25 percent of a radial surface area defined within the outer contact perimeter.

12. The engine assembly of claim 11, wherein the first axial end surface is generally planar within the outer contact perimeter and the second axial end surface includes a recess within the outer contact perimeter to form the chamber.

13. The engine assembly of claim 11, wherein the first axial end surface includes a first recess within the outer contact perimeter to form the chamber.

14. The engine assembly of claim 13, wherein the second axial end surface includes a second recess within the outer contact perimeter, the first and second recesses forming the chamber.

15. The engine assembly of claim 13, wherein the second axial end surface is generally planar within the outer contact perimeter.

16. The engine assembly of claim 11, wherein the radial surface area of the chamber formed by the first and second axial end surfaces is between 50 and 95 percent of the radial surface area defined by the outer contact perimeter.

17. The engine assembly of claim 11, wherein the first and second axial end surfaces are radially displaceable relative to one another.

18. The engine assembly of claim 11, wherein the valve mechanism includes a valve holder and a valve member, the valve holder including the second axial end surface at a first axial end and a third axial end surface at a second axial end opposite the first axial end, the third axial end surface including a recess housing the valve member.

19. The engine assembly of claim 18, wherein the valve member includes a ball.

20. The engine assembly of claim 11, further comprising an injection valve, the housing including an injection nozzle opening, the injection valve being displaceable from a third position where the injection valve seals the injection nozzle opening to a fourth position where the injection valve opens the nozzle opening, the injection valve being displaced from the third position to the fourth position by fuel pressure when the valve mechanism is displaced from the first position to the second position.

* * * * *